US006280689B1

(12) United States Patent
Stevens

(10) Patent No.: US 6,280,689 B1
(45) Date of Patent: Aug. 28, 2001

(54) DRIPLESS PIPET

(75) Inventor: Timothy A. Stevens, Warwick, NY (US)

(73) Assignee: Becton Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/361,838

(22) Filed: Jul. 27, 1999

(51) Int. Cl.[7] ..... B01L 3/02

(52) U.S. Cl. ..... 422/100; 73/864.01; 436/54; 436/180

(58) Field of Search ..... 422/100; 436/54, 436/180, 810; 73/864.01

(56) References Cited

U.S. PATENT DOCUMENTS 4,147,752 * 4/1979 Suovaniemi et al. .
4,923,798 * 5/1990 LeMoine et al. .
5,260,030 * 11/1993 DeVaughn .
5,844,686 * 12/1998 Treptow et al. .
6,071,231 * 6/2000 Mendoza et al. .
6,117,394 * 9/2000 Smith .

* cited by examiner

*Primary Examiner*—Jan Ludlow
(74) *Attorney, Agent, or Firm*—Nanette S. Thomas

(57) ABSTRACT

A pipet provides for dispensing a fluid medium into an open-ended collection container including an improved dripless tip. The pipet includes a tip body with a cross shaped passage structure that spans the length of the tip body. This cross shaped passage structure is designed to contact the liquid medium that passes into the tip and onto the open distal end of the tip and prevent unwanted dripping therefrom.

2 Claims, 5 Drawing Sheets

DRIPLESS PIPET

BACKGROUND OF THE INVENTION

1. Field of the Invention

The present invention relates to pipets for dispensing and aspirating a fluid medium. More particularly, the present invention relates to a pipet having an improved tip or dispensing portion which is constructed to reduce the tendency for dripping.

2. Description of Related Art

In laboratory and industrial settings it is well known to use a pipet to extract a certain volume of a fluid medium from one container and to transport and dispense some or all of the extracted volume into another container. Depending upon the nature of each given application, the volume of fluid medium to be extracted and dispensed must be measured accurately. Most pipets employ an open-ended tapered tip through which the fluid medium is drawn and extracted. During such operations, it is critical that the pipet not drip so that accurate volumes are dispensed. Moreover, in certain industrial or scientific manipulations where precise volume deliveries are critical, such as for example, in molecular biology applications including DNA sequencing, in situ hybridization, and enzyme digestion and in certain tissue culture applications, dripless pipet tips are essential.

Typically pipets are generally hollow tubular members which are used by applying suction at an open upper end or mouthpiece in order to extract or aspirate a quantity of fluid medium into the hollow tube. A pressure differential maintained by closing the mouthpiece opening retains the fluid within the pipet allowing transport of the fluid medium to another container. Selective opening of the mouthpiece allows a quantity of the fluid medium contained in the pipet to be dispensed. A certain degree of accuracy in the amount of fluid dispensed is provided by the tapered end portions by reducing the amount of fluid lost due to dripping.

Plastic pipets have largely replaced glass pipets for many uses. Commercially available plastic pipets, however, have a serious draw-back. Plastic pipets typically have a molded or a drawn dispensing tip in the shape of a hollow cone with an open, narrow end. Such tips tend to drip or leak, especially in larger pipets, in which the opening of the cone typically has a greater taper angle to allow for speedy dispensing of larger volumes. Dripping and leaking can be reduced by decreasing the size of the opening or narrowing the taper angle. However this would restrict liquid flow therethrough to an unacceptable level.

Given the nature of pipets and the need for accuracy in the volume of medium which is dispensed, it is common to employ different sized pipets for different volume applications. Large volume pipets, those having a capacity in excess of 50 ml are, quite naturally, of larger size than small volume pipets, those having a capacity under 50 ml.

In many large volume pipets, the size of the dispensing tip is such that it is difficult to control the dispensing of fluid from the pipet. Thus, even upon creation of the pressure differential by closing the mouthpiece, fluid medium has a tendency to drip from the mouthpiece resulting in lack of control in the accuracy of dispensing.

Accordingly, it is desirable to provide a pipet having a dripless tip for use in accurately dispensing specified volumes of a fluid medium which is easy to manufacture and to use.

SUMMARY OF THE INVENTION

The present invention is a pipet tip that can accurately aspirate and dispense a specified volume of fluid medium.

Most preferably, the pipet tip includes a structure within the open end of the tip for restricting flow of liquid medium therethrough.

The present invention provides a dripless pipet tip wherein the surface area of the tip is increased by imprinting a cross-shaped structure which increases the effective surface tension of the fluid medium contained therein.

Most preferably, the pipet tip includes an elongate hollow tip body having an open distal end defined by a perimetrical wall. The tip is capable of allowing a fluid medium to pass therethrough. The tip includes a wall structure that spans the open distal end of the tip body. Furthermore, the wall structure extends between at least two spaced apart locations on the perimetrical wall. This wall structure contacts the liquid medium that passes through the open distal end of the tip to effect a reduction in dripping.

The pipet tip further includes a generally circular perimetrical wall that includes an elongated wall member that is diametrically across from the perimetrical wall. The wall structure may further include first and second diametrically extending intersecting wall members. Moreover, the first and second wall members may intersect at a right angle forming a cross-shaped structure. In this embodiment, the elongate hollow tip body is generally frustoconically shaped. In addition, the wall structure may further be physically or chemically etched along its surface. These etched surfaces serve to further increase surface contact between the wall structure and the fluid medium.

Alternatively, the pipet tip includes the cross shaped structure the entire length of the pipet tip. Therefore, more effectively reducing dripping out of the pipet tip.

DETAILED DESCRIPTION

Figure 1:
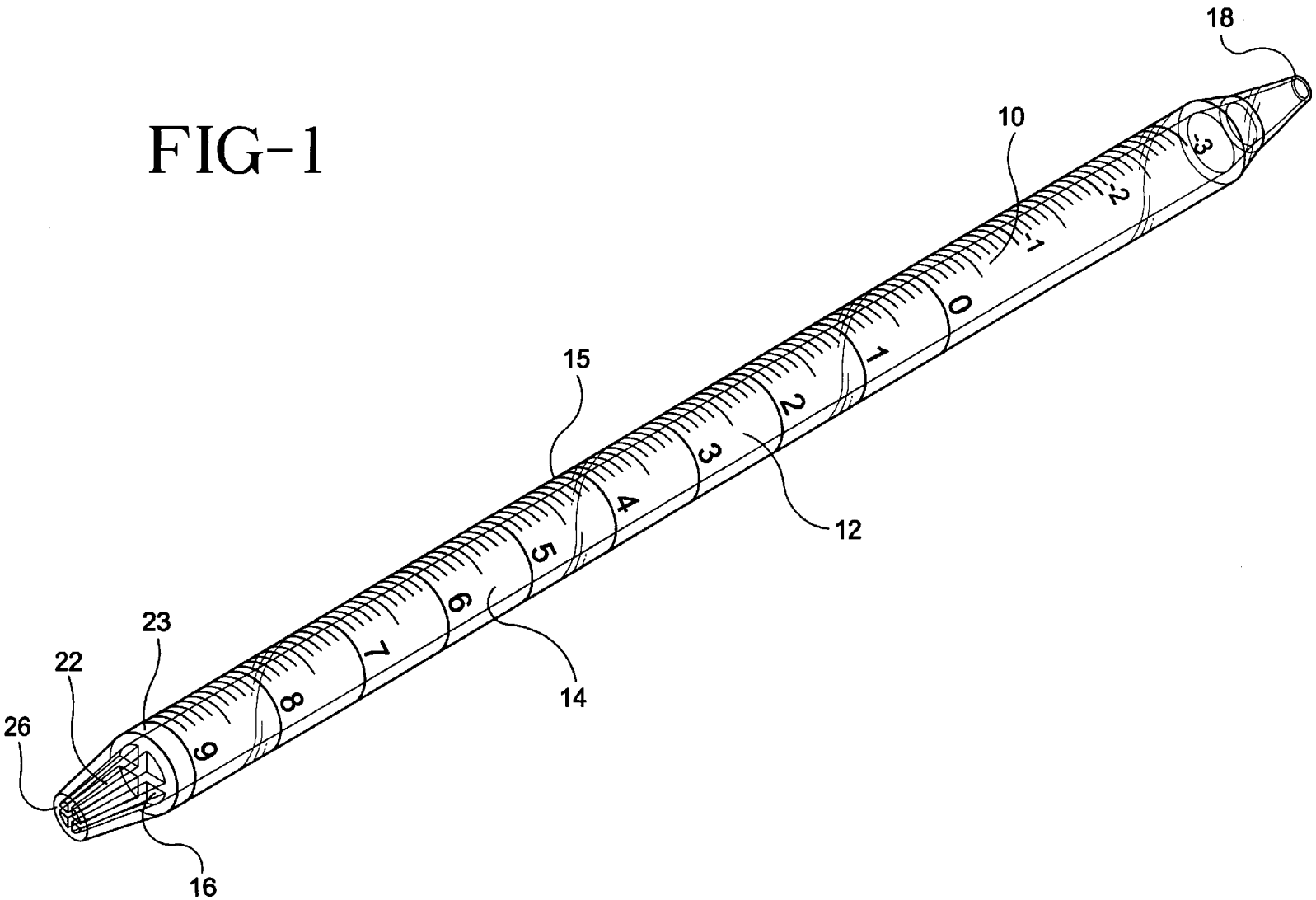
FIG. 1 is a perspective showing a pipet having a dripless tip of the present invention.

Referring to FIG. 1, a pipet 10 of the present invention is shown. Pipet 10 is generally an elongate tubular member defined by a tubular wall 12 of generally uniform wall thickness. Pipet 10 may be formed of molded transparent plastic such as polystyrene. Within tubular wall 12, a pipet interior 14 is defined for accommodating a given volume of fluid medium. Pipet 10 includes an elongate generally cylindrical main body portion 15 coextensive with interior 14. In order to aspirate and dispense the fluid medium, pipet 10 includes a dispensing portion 16 at one end of body 15 and a mouthpiece 18 at the other end. Both dispensing portion 16 and mouthpiece 18 are in communication with the interior 14 of pipet 10 so as to permit aspirating and dispersing of the fluid medium through dispensing portion 16 by creating a selective pressure differential within the interior 14 of pipet 10 using mouthpiece 18. Such a pressure differential can be created manually by opening and closing mouthpiece 18 or may be created by use of mechanical pipet aids.

FIGS. 2–5 show dispensing portion 16 in further detail. Dispensing portion 16 includes a first or proximate extent 23 adjacent main body 15 of pipet 10. Proximate extent 23 is frustoconical in shape tapering from a wider expanse adjacent main body 15. Dispensing portion 16 further includes a second or distal extent 22 which extends from proximate extent 23. Distal extent 22 is also frustoconically shaped tapering from a wide expanse adjacent proximate extent 23 to a narrow expanse at a distal end 24. Distal end 24 includes a circular wall 25 which defines openings 26*a*, 26*b*, 26*c*, and 26*d* through which the fluid medium enters or exits pipet 10.

Figure 2:
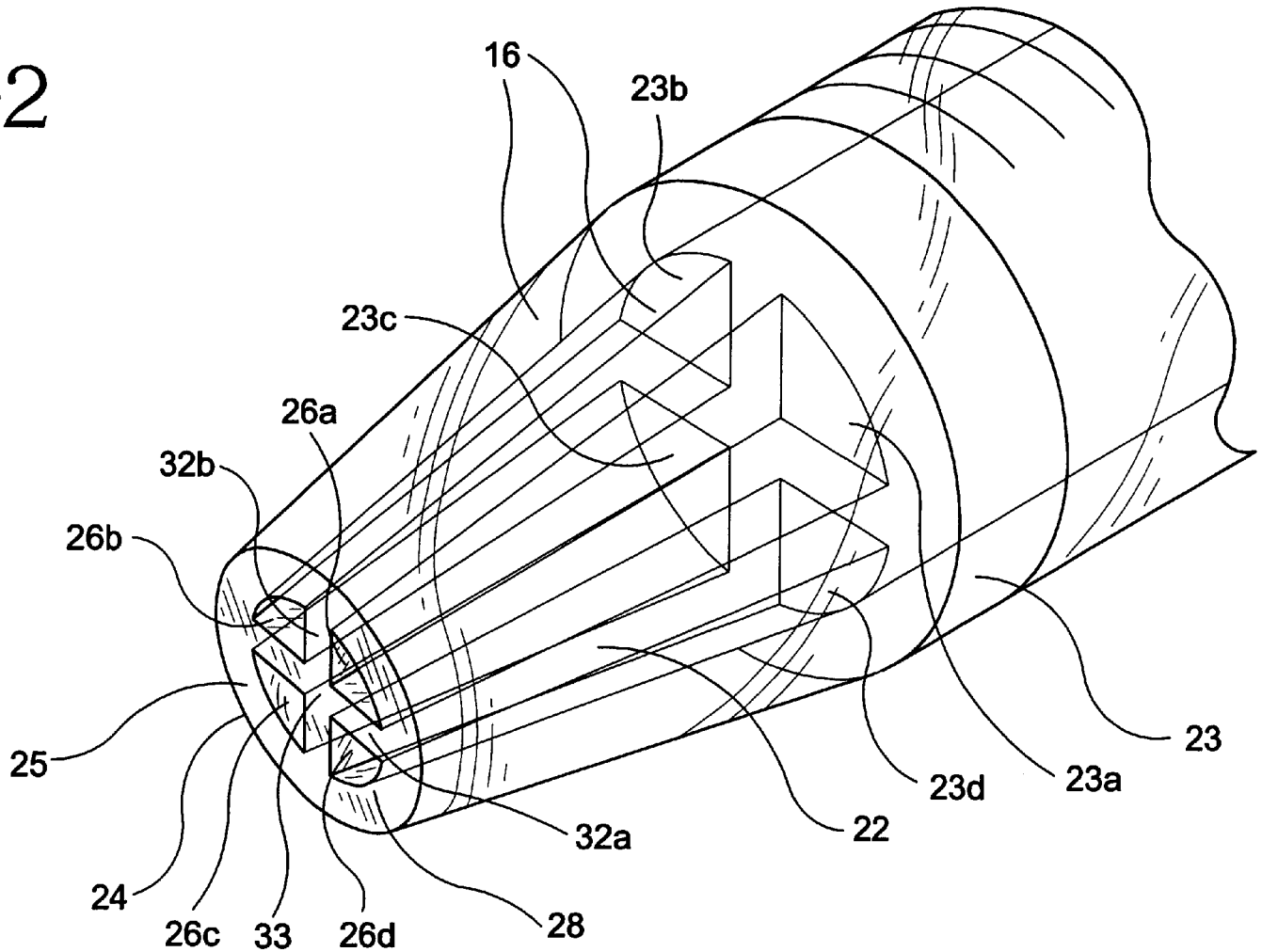
FIG. 2 is an enlarged perspective view of a portion of the pipet of FIG. 1 showing the dripless tip.
Figure 3:
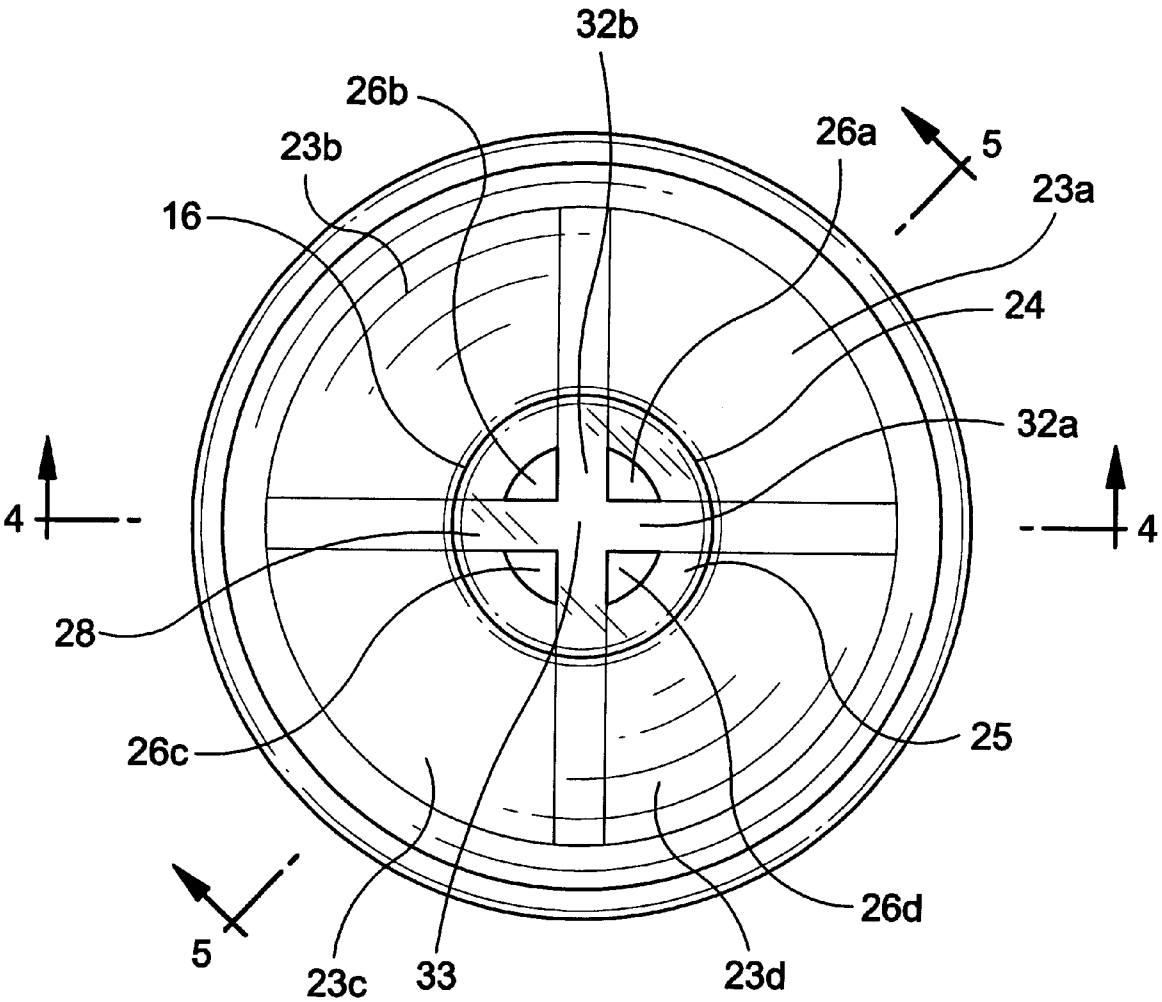
FIG. 3 is a distal end view of the dripless tip of the pipet of FIG. 1.
Figure 4:
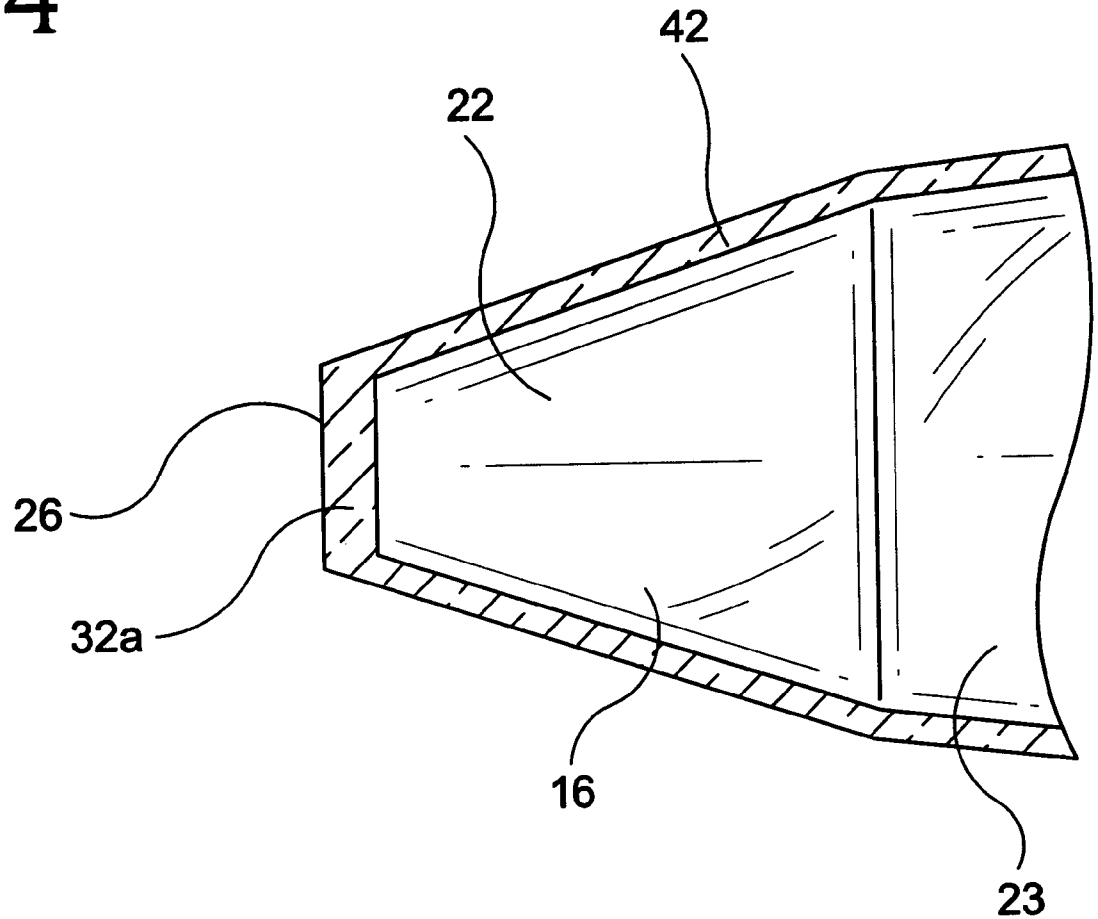
FIG. 4 is an enlarged cross-sectional view of a portion of the pipet tip of FIG. 3 taken through the line 4—4 thereof.
Figure 5:
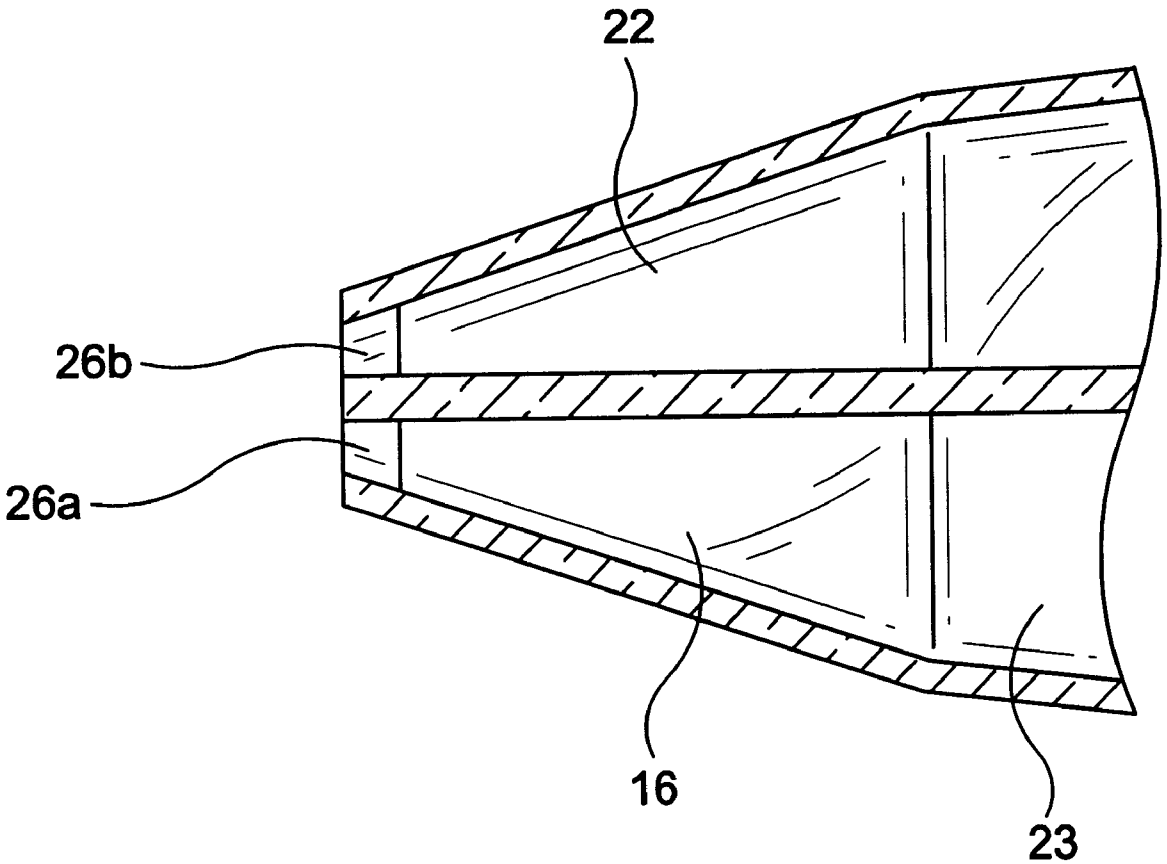
FIG. 5 is an enlarged exploded cross-section of a portion of the pipet tip of FIG. 3 taken through line 5—5 thereof

As depicted in FIG. 2, two wall members 32*a* and 32*b* span from proximate extent 23 to distal end 24. Wall members 32*a* and 32*b* intersect each other at right angles to form a generally cross-shaped structure 33. Thus, wall members 32*a* and 32*b* provide partitions 26*a*, 26*b*, 26*c* and 26*d* at distal end 24 and partitions 23*a*, 23*b*, 23*c*, and 23*d* at proximate extent 23. The width of each wall member 32*a* and 32*b* is sufficient to prevent dripping of liquid medium from dispensing portion 16 but is not so great so as to restrict flow through openings 26 and 23 to an unacceptable level.

Further included to increase surface tension without unduly impeding flow through partitions 26*a*–26*d* may have an etched surface or chemically treated surface to provide enhance surface tension of the fluid and minimize dripping.

Dispensing portion 16 of the present invention is designed to work with any conventionally sized pipet. In the particular embodiment shown herein, pipet 10 is designed as a 10 ml pipet having an actual maximum capacity of approximately 13 ml. However, both larger and smaller volume pipets may be employed with the present invention.

Various changes to the foregoing described and shown structures would now be evident to those skilled in the art. Accordingly, the particularly disclosed scope of the invention is set forth in the following claims.

What is claimed is:

1. A pipet for aspirating and dispensing a medium comprising:

an elongate hollow tip body;

a dispensing portion connected with said tip body for providing surface contact with said medium passing through said tip body, comprising a proximate extent adjacent said tip body comprising a frustoconical structure tapering from a first wide expanse adjacent said tip body to a second wide expanse, a distal extent extending from said proximate extent comprising a frustoconical structure tapering from said second wide expanse of said proximate extent to a narrow expanse at a distal end and four openings extending from said proximate extent to said distal end of said distal extent.

2. The pipet of claim 1, wherein said dispensing portion is etched for increasing the surface area of said dispensing portion for contacting said fluid medium.

* * * * *